US008550182B2

(12) United States Patent
Ouellet et al.

(10) Patent No.: US 8,550,182 B2
(45) Date of Patent: Oct. 8, 2013

(54) ELECTROMAGNETIC ENERGY ASSISTED DRILLING SYSTEM AND METHOD

(75) Inventors: Jacques Ouellet, Regina (CA); Peter Radziszewski, Baie d'urfe (CA); Vijaya Raghavan, Pincourt (CA); Hemanth Satish, Calgary (CA); Ferri Hassani, Beaconsfield (CA)

(73) Assignee: McGill University, Montreal (CA)

( * ) Notice: Subject to any disclaimer, the term of this patent is extended or adjusted under 35 U.S.C. 154(b) by 783 days.

(21) Appl. No.: 12/375,317

(22) PCT Filed: Jul. 30, 2007

(86) PCT No.: PCT/CA2007/001343

§ 371 (c)(1),
(2), (4) Date: Sep. 14, 2009

(87) PCT Pub. No.: WO2008/011729

PCT Pub. Date: Jan. 31, 2008

(65) Prior Publication Data

US 2009/0321132 A1 Dec. 31, 2009

Related U.S. Application Data

(60) Provisional application No. 60/820,687, filed on Jul. 28, 2006.

(51) Int. Cl.
*E21B 7/14* (2006.01)
*E21B 10/00* (2006.01)

(52) U.S. Cl.
USPC ..... 175/11; 175/15; 175/17; 175/327; 166/302; 166/57

(58) Field of Classification Search
USPC ..... 166/302, 57, 243; 175/11, 15, 17, 327
See application file for complete search history.

(56) References Cited

U.S. PATENT DOCUMENTS

| | | | | | |
|---|---|---|---|---|---|
| 3,357,505 | A * | 12/1967 | Armstrong et al. | ..... | 175/16 |
| 3,443,051 | A * | 5/1969 | Puschner | ..... | 299/14 |
| 3,601,448 | A * | 8/1971 | Stone | ..... | 299/14 |
| 3,693,731 | A * | 9/1972 | Armstrong et al. | ..... | 175/11 |
| 4,590,348 | A * | 5/1986 | Lahti et al. | ..... | 219/697 |
| 4,620,593 | A * | 11/1986 | Haagensen | ..... | 166/248 |
| 5,003,144 | A | 3/1991 | Lindroth et al. | | |
| 5,449,889 | A * | 9/1995 | Samardzija | ..... | 219/695 |
| 5,479,994 | A | 1/1996 | Soloviev et al. | | |
| 5,735,355 | A * | 4/1998 | Bussod et al. | ..... | 175/11 |
| 6,114,676 | A | 9/2000 | Jerby et al. | | |
| 6,150,822 | A * | 11/2000 | Hong et al. | ..... | 324/338 |
| 6,583,395 | B2 * | 6/2003 | Furtlehner et al. | ..... | 219/695 |
| 2001/0022464 | A1 | 9/2001 | Seear | | |
| 2005/0024284 | A1 * | 2/2005 | Halek et al. | ..... | 343/771 |

* cited by examiner

*Primary Examiner* — William P Neuder
*Assistant Examiner* — Robert E Fuller
(74) *Attorney, Agent, or Firm* — Goudreau Gage Dubuc; Hugh Mansfield

(57) ABSTRACT

A drill bit, system and method for penetrating a material such as a mineral bearing rock or the like. The system comprises a drill bit comprising a cutting face comprising at least one cutting tool, an emitter of microwaves positioned behind the cutting face, wherein at least a portion of the microwaves are emitted in a direction away from the cutting face, and a reflector for directing the portion to the cutting face. In operation the emitted microwaves irradiate the material prior to the irradiated material being removed by the at least one cutting tool.

16 Claims, 8 Drawing Sheets

ELECTROMAGNETIC ENERGY ASSISTED DRILLING SYSTEM AND METHOD

CROSS-REFERENCE TO RELATED APPLICATIONS

This application is a National Entry Application of PCT application no PCT/CA2007/001343 filed on Jul. 30, 2007 and published in English under PCT Article 21(2), which itself claims priority on U.S. provisional application Ser. No. 60/820,687, filed on Jul. 28, 2006. All documents above are incorporated herein in their entirety by reference.

TECHNICAL FIELD

The present invention relates to an electromagnetic energy assisted drilling system and method. More specifically, the present invention relates to a system and method wherein a material such as rock, which prior to excavation using a cutting tool such as a drill is first exposed to low energy microwave radiation in order to reduce the strength of the rock and improve drilling efficiency.

BACKGROUND OF THE INVENTION

A variety of mechanical machines, such as drilling, tunnelling and continuous mining machines are available for cutting rock formations. One drawback of these prior art machines is that they are designed primarily for working relatively soft rock formations and as a result, application of these machines and techniques to hard rock such as granite and basalt is either not possible or inefficient due to slow speed and increased tool wear.

In order to address this problem, the prior art reveals thermally treating the hard rock formations prior to cutting in order to introduce subsurface fractures and weaken the rock. These prior art methods and devices reveal the use of a variety of thermal sources such as gas jets, lasers and radiant electric heaters and the like, but have proven less than optimal due to their limited effect, large expense and additional time required.

The prior art also reveals thermally treating rock formations using microwaves in order to introduce thermal expansion causing tensile stress thereby fracturing and weakening the rock so that it is more susceptible to subsequent excavation by mechanical mining machines. One drawback of these prior art methods is that, as the microwaves are not optimised in order to maximise the effect of thermal expansion weakening of the rock is reduced, or alternatively high power microwave sources must be used thereby reducing efficiency.

SUMMARY OF THE INVENTION

In a first aspect, the present invention provides a drill bit for penetrating a material. The drill bit comprises a cutting face comprising at least one cutting tool, an emitter of microwaves positioned behind the cutting face, wherein at least a portion of the microwaves are emitted in a direction away from the cutting face, and a reflector for directing the portion to the cutting face. In operation the emitted microwaves irradiate the material prior to the irradiated material being removed by the at least one cutting tool.

The present invention further provides a microwave-assisted drilling system for penetrating a material. The system comprises a source of electromagnetic energy, a hollow drill rod, a source of motive energy for driving the drill rod, an elongate coaxial waveguide positioned along an inside of the drill rod, a drill bit attached at a distal end of the drill rod, the drill bit comprising: a cutting tool, and a microwave antenna terminating the coaxial waveguide adjacent to the cutting tool and in operative interconnection with the source of electromagnetic energy. In operation the antenna irradiates the material with the electromagnetic energy prior to the irradiated material being removed by the cutting tool.

The present invention further provides a method of thermally treating an aggregate, the aggregate comprising a heterogeneous mixture of materials suspended in a matrix, the method comprising: selecting one of the materials, the selected material increasing in temperature when excited by an electromagnetic field, determining a frequency of electromagnetic radiation which induces a thermal expansion in the selected material that is greater than a thermal expansion induced in a non-selected material, and subjecting the material to electromagnetic radiation at the selected frequency with an intensity and duration sufficient to introduce fractures into the aggregate.

Other objects, advantages and features of the present invention will become more apparent upon reading of the following non-restrictive description of specific embodiments thereof, given by way of example only with reference to the accompanying drawings.

DETAILED DESCRIPTION OF THE INVENTION

Figure 1:
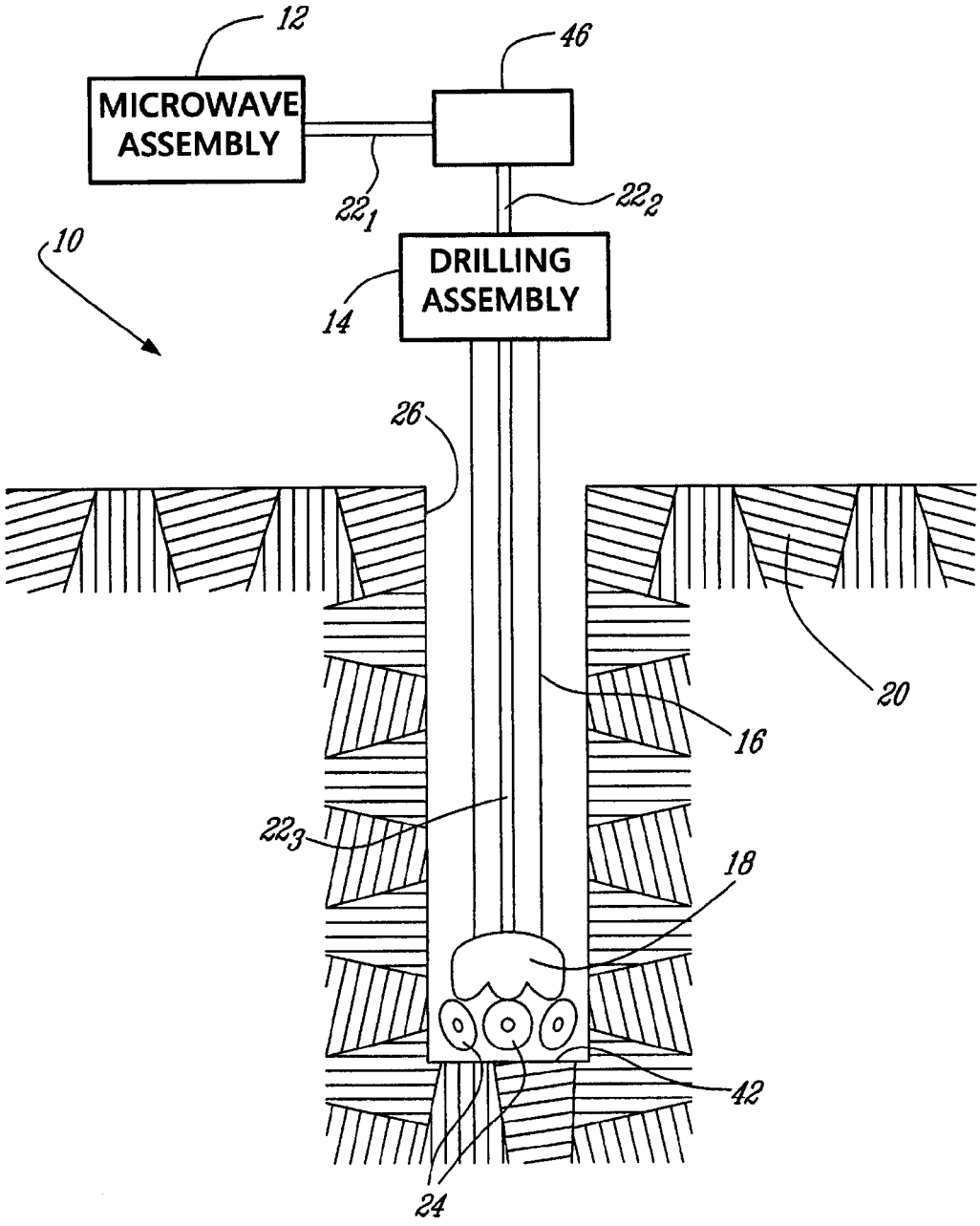
FIG. 1 shows a side plan view of an electromagnetic energy assisted mining system in accordance with an illustrative embodiment of the present invention.

Referring to FIG. 1, an electromagnetic energy assisted mining system, generally referred to using the reference numeral 10, will now be described. The system 10 is illustratively comprised of a microwave assembly 12 for generating microwave energy and a drilling assembly 14 comprising a drill rod (or string) 16 and an excavation bit 18 for drilling into an aggregate 20. The microwave assembly 12 and the drilling assembly 14 are interconnected by a transmission line comprised of a series of waveguides as in 22 and interconnected in order to transfer the microwave energy generated by the microwave assembly 12 to a point proximate the excavation bit 18. In operation, and as will be apparent to a person of ordinary skill in the art, the excavation bit 18, by means of one or more cutting heads 24, excavates or otherwise bores (typically by rotary motion or impact force) a shaft 26 in the aggregate 20.

Figure 2:
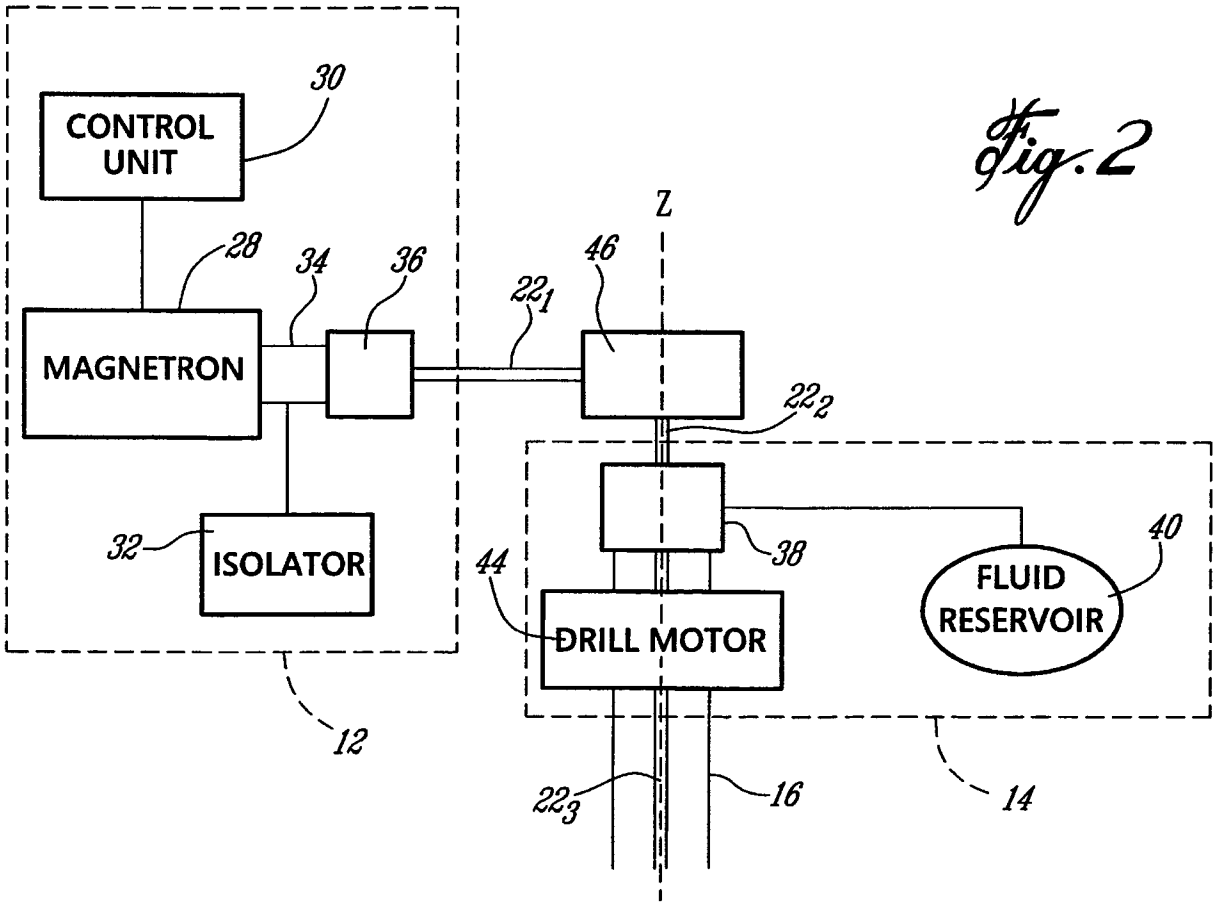
FIG. 2 shows a schematic diagram of a microwave assembly and a drilling assembly of an electromagnetic energy assisted mining system in accordance with an illustrative embodiment of the present invention.
Figure 3B:
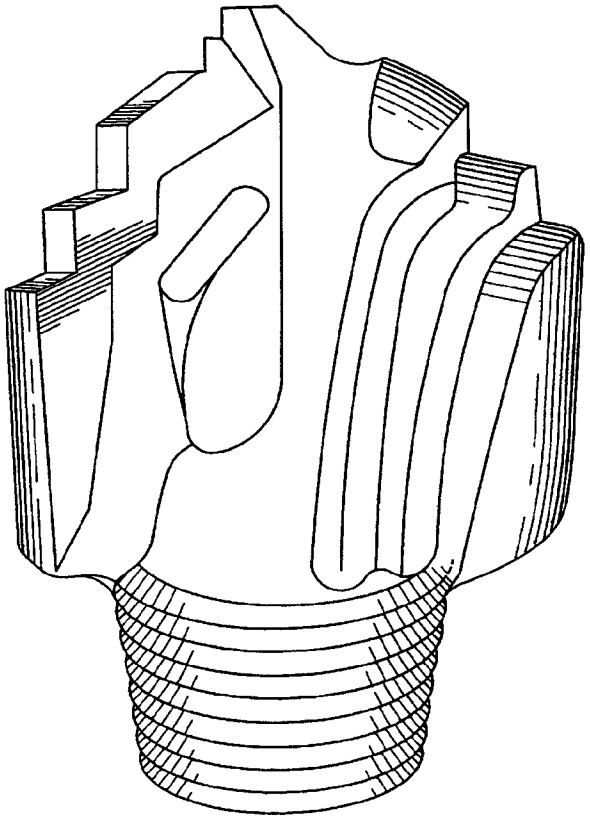
FIGS. 3(*a*) through 3(*d*) show different types of excavation bits in accordance with an illustrative embodiment of the present invention.
Figure 3A:
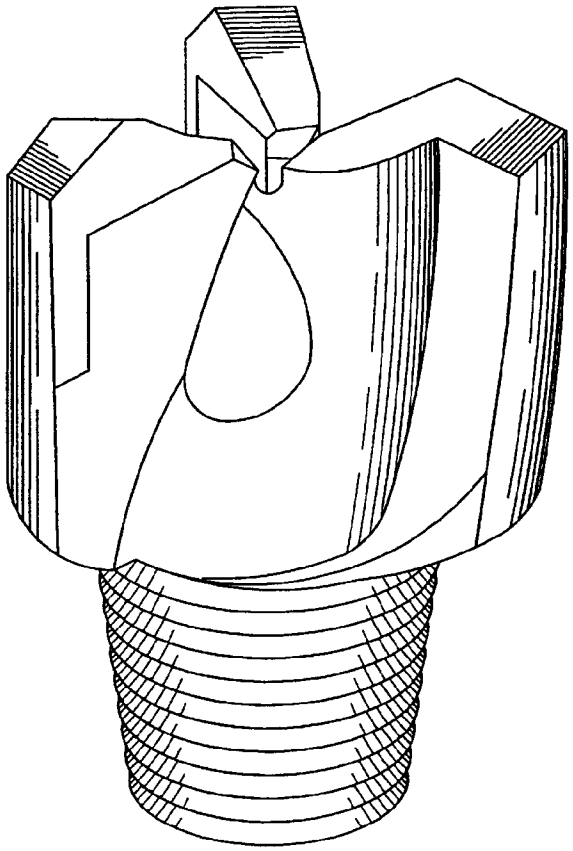
Figure 3D:
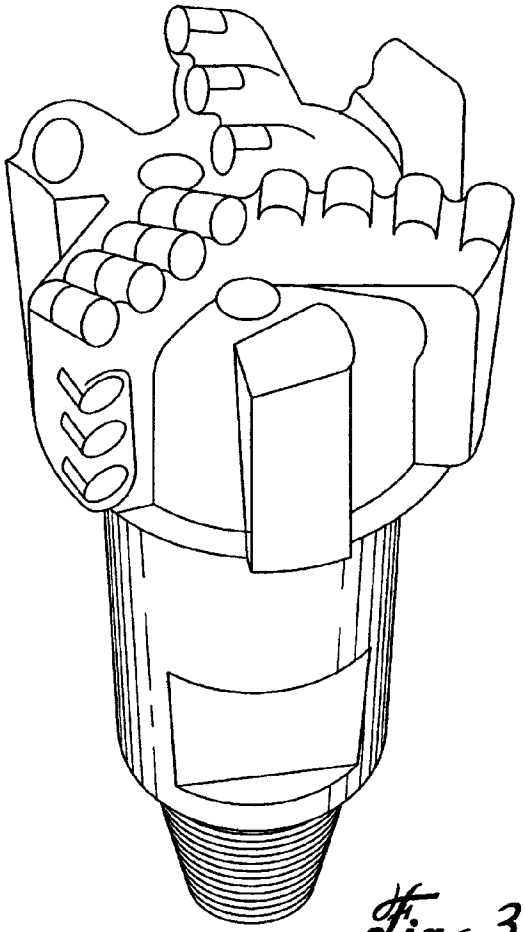
Figure 3C:
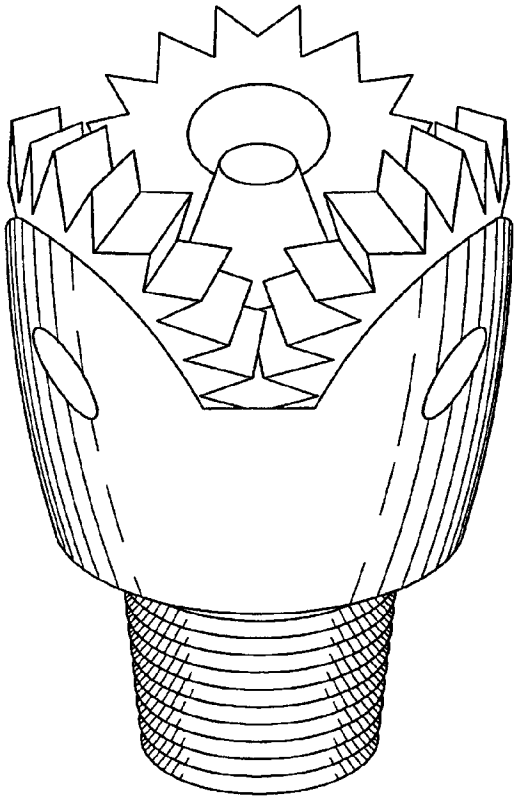

Referring now to FIG. 2 in addition to FIG. 1, the microwave assembly 12 is illustratively comprised of an electromagnetic energy generator 28, such as a magnetron, connected to a control unit 30 and an isolator 32. To transmit the energy generated by the magnetron to the drilling assembly 14 via the waveguides as in 22, the output of the magnetron 28 is fed into a waveguide 34 via an adapter 36, which will be discussed in more detail herein below.

Electromagnetic energy generators come in two classes, namely solid-state devices and vacuum tubes. Solid-state devices are expensive and short of power output requirements when compared to vacuum tubes and thus their use for industrial applications is not widespread. Vacuum tube generators are of three types, namely magnetron, klystron and travelling wave tubes. Magnetrons are the most commonly used microwave generators given their low cost, compact size, support for low power devices and excellent frequency stability.

The magnetron 28, whose power intensity is controlled by the control unit 30, is used to reduce the strength of the aggregate 20 and improve drilling efficiency by exposing the aggregate 20 to electromagnetic energy (in the form of RF/microwaves) prior to cutting by the excavation bit 18. It converts electrical energy from an external electrical power source (not shown) used to supply electrical power to the system 10 into microwave energy. Although standardised frequencies of 915 MHz, 2.45 GHz, 5.8 GHz and 22.125 GHz have been designated for industrial, scientific and medical applications (with many conventional sources of microwave heating operating at 2.450 GHz), illustratively it is foreseen that electromagnetic energy from 300 MHz to 300 GHz can be supplied, although as will be discussed in more detail below, the selection of the frequency or frequencies ultimately to be supplied depends on the nature of the material (rock) being excavated. The power output of electromagnetic energy generators typically ranges from 500 W to 10 KW at 2.45 GHz and as high as 75 KW for a frequency of 915 MHz. In the preferred embodiment of the present invention, the magnetron 28 is illustratively operated at a frequency of 2.45 GHz and at a power of 3 kW.

Still referring to FIG. 2 in addition to FIG. 1, as known in the art, some of the emitted microwave energy will be reflected back towards the magnetron 28, thus potentially damaging the device. In order to protect the magnetron head from microwave reflections, the isolator 32 is placed between the magnetron 28 and the drill components of the drilling assembly 14. With the isolator 32 in place, the magnetron 28 can transmit microwave energy towards the excavation bit 22, while energy flow in the opposite direction is absorbed and thus restricted by the isolator 38. The isolator 32 is illustratively tuned to the operating frequency of 2.45 GHz and selected so as to withstand the full power load of the system 10 (illustratively 3 kW).

The location of the microwave assembly 12 relative to the drilling assembly 14 (i.e. inside or outside the shaft 26) depends on design requirements. Illustratively, the microwave assembly 12 may be housed inside the shaft 26 in a compartment placed on the drill rod 16 directly above the excavation bit 18. However, in this case, the diameter of the compartment would preferably have to be smaller than that of the excavation bit 18 (illustratively about three (3) inches or eight (8) cm), thus leaving little room for the microwave components. Moreover, electrical wires would need to be routed through the drill rod 16 to connect the excavation bit 18 to an external electrical power source (not shown), which provides power to the system 10. As a result, it is desirable, for sake of simplicity, to keep the microwave components outside of the shaft 26.

Still referring to FIG. 2 in addition to FIG. 1, microwave energy is transported from the microwave assembly 12 to the drilling assembly 14 (more specifically into the drill rod 16 towards the drill bit 18) and into the rock 20 using a transmission line comprising of waveguides as in 22. Waveguides are metallic conduits, which can be of either rectangular or circular cross section depending on the mode of transmission. They have the advantage of exhibiting low power loss per unit length when their dimensions are selected properly, these dimensions depending on the frequency of the magnetron 28, which further dictates the wavelength of the microwaves generated. As known in the art, at a frequency of 2.45 GHz, the inner dimensions of the waveguide 22 would be about 8.6×4.3 cm. These dimensions are not an issue for transporting the microwave energy outside the shaft 26 and since the microwave assembly 12 is illustratively placed above the shaft 26, a short length rectangular waveguide as in 34 may be used at the magnetron's output. However, to transport the microwave energy inside the shaft 26, namely through the drill rod 16 and towards the end of the excavation bit 18, a waveguide having the dimensions mentioned herein above would be well above the bit's desired diameter of 8 cm and thus cannot be used.

A first alternative would be to decrease the size of the waveguide 22. However, as known in the art, microwaves are prevented from propagating in smaller waveguides and decreasing the size of the waveguide 22 would therefore result in large power losses. Another option would be to use an excavation bit 18 having a larger diameter. This would however increase the torque required to drive the excavation bit 18, resulting in higher costs. Using a coaxial cable for microwave transmission within the shaft 26 thus appears as a more suitable solution. Indeed, coaxial cables have the advantage of being very small compared to waveguides of circular cross-section as well as being capable of handling the desired operating power and frequency range. A high load shielded and armoured coaxial cable is therefore illustratively used as the waveguide 22 connecting the microwave assembly 12 to the drilling assembly 14 and transmitting microwave energy to the excavation bit 18.

Still referring to FIG. 2, as discussed above, the waveguide-to-coaxial adapter 36 is illustratively used to channel the microwaves from the waveguide 34 to the coaxial cable 22. A variety of such adapters are well known in the art. Still, it is desirable for the adapter 36 to be rotary, as this will allow the magnetron 28 to remain stationary while the coaxial cable 22 rotates with the excavation bit 18, thus improving the performance of the system 10. In this case, the adapter 36 is illustratively secured to the waveguide 34 and microwaves travel horizontally into it before leaving vertically through the coaxial cable 22.

Still referring to FIG. 2 in addition to FIG. 1, the drilling assembly 16 comprises a swivel 38, which, as known in the art, transports drilling fluid (e.g. pressurized air, water, or mud) needed for debris removal from a stationary fluid reservoir 40 (for example, a mud pit or the like), where it is stored, to the drill rod 16. As known in the art, the drill rod 16 provides an avenue for removing rock chips, dust and other debris, which would otherwise accumulate at the bottom surface 42 of the shaft 26 during excavation. Such debris removal is typically effected by passing a pressurized fluid such as air, water or drilling mud (not shown) through the drill rod 16 and excavation bit 18. The fluid is then forced around the excavation bit 18 and out of the shaft 26, together with the cutting debris. As opposed to manual debris removal, this method doesn't slow the drilling process down and has the advantage of being simple and additionally functioning to cool the drilling components, thus making them less susceptible to damage. Since air does not significantly absorb microwaves and has no electrical hazards compared to water, it is chosen as the circulating fluid.

Still referring to FIG. 2 in addition to FIG. 1, upon exiting the microwave assembly 12, the rotating coaxial cable 22 is inserted into the swivel 38, which is in turn connected to the drill rod 16. As the coaxial cable 22 is illustratively passed through the swivel 38 such that it is concentric with the axis of rotation Z of the drill rod 16, it is desirable to create a cable passage, which would provide sufficient room for the coaxial cable 22 to pass through it without severely obstructing the flow of fluid through the hollow inside of the drill rod 16. For this purpose, an elbow-style swivel or a through-style swivel may be used, with the type of swivel being selected according to design requirements (e.g. size and price). In elbow-style swivels, air is supplied through the side, and the cable passage could then be located at the top of the swivel. When using through-style swivels, air is supplied through the top, and an elbow-style adaptor is used to allow the cable to be inserted into the swivel concentrically with the axis of rotation Z. Such an elbow-style adaptor would then be screwed to the top of the swivel instead of the intended air supply line, thus removing the need for modifying the swivel itself. The air supply would thus come from the side, allowing for a cable passage for the coaxial cable 22 in the top of the swivel 38, the passage being concentric with the axis of rotation Z. Also, since the design may be used with varying cable sizes, it is desirable for the adapter to comprise at its top a plug, seal, or the like (not shown), which tightens around the cable passing through it while preventing the high-pressure fluid (e.g. air) from leaking.

Still referring to FIG. 2, the drill rod 16 is attached to the free end of the swivel 38, such that the coaxial cable 22 is concentric with the drill rod's axis of rotation Z, and is permitted to rotate relative to it. In order to provide sufficient space for the coaxial cable 22 to pass through the drill rod 16 without obstructing fluid flow, a drill rod 22 with a spacious hollow cylindrical core is illustratively chosen. A drill motor 44 is then attached to the drill rod 16 to provide the required thrust and torque to the drill rod 16 (and attached excavation bit 18). Since the coaxial cable 22 is concentric with the drill rod 16 and it is desirable for the top of the swivel 38 to remain stationary (in order to prevent components of the microwave assembly 12 from rotating with the components of the drilling assembly 14), the drill motor 44 is preferably clamped below the swivel 40 around the upper section of the drill rod 16.

Still referring to FIG. 2 in addition to FIG. 1, a rotary connection 46, such as a slip ring or the like, is illustratively integrated in the transmission line to ensure that the components of the microwave assembly 12 stay stationary while the components of the drilling assembly 14 (i.e. the drill rod 16, the coaxial cable 22 and the attached excavation bit 18) are free to rotate. As will be apparent to a person of skill in the art, although the rotary connection 46 could be positioned within the drill bit 18, it is placed above the drill rod 16 in order to comply with the design requirements (especially in terms of size). Depending on cost, lead-time, and associated power loss to a lesser degree, three types of rotary connections may be used: waveguide-to-waveguide, waveguide-to-coaxial, and coaxial-to-coaxial. In the preferred embodiment of the present invention, a coaxial-to-coaxial rotary joint 46, which forms a 90° angle is used. In this regard, the coaxial cable $\mathbf{22}_1$, exiting the microwave assembly 12 connects to one end of the rotary joint 46 on one side, while the coaxial cable $\mathbf{22}_2$ running through the drill rod 16 (and through the swivel 38) connects to the other end to transmit microwave energy towards the excavation bit 18. To accommodate for rotation of the drilling components while maintaining the microwave components stationary, the upper part of the rotary joint 46 remains illustratively stationary while the lower part rotates. In this manner, the microwave assembly 12 doesn't move while the drilling assembly is allowed to rotate so as to excavate the rock 20.

Referring now to FIGS. 3(*a*) through 3(*d*) and as known in the art, depending on the subsurface conditions, several drill bit types may be used. Some applications use percussion drilling, where air-driven hammers operate the drill bits. During drilling the bit remains in close contact with the rock at the bottom of the hole at all times except during the slight rebound caused by impact of the hammer. Although percussion drilling produces acceptable drilling holes and is generally the most economical drilling method, this advantage decreases with depth. An alternative is rotary drilling, in which a hole is made by advancing a drilling bit attached to a rotating column of hollow drill pipe. Drag bits (as illustrated in FIGS. 3(*a*) and 3(*b*)), which use fixed cutting tools, are typically used to drill soft rocks since they are not structurally strong enough to fracture hard rock without breaking down. Rock bits (illustrated in FIG. 3(*c*)), which are stronger, are made of toothed rollers or cones, each of which turns or rolls on the rock as the bit rotates with the drill rod it is attached to. The teeth and other parts of the bits subjected to intense abrasion are made of hard alloys. Diamond bits (illustrated in FIG. 3(*d*)) employ diamond-studded bits to cut the rock. The diamonds are scattered into a soft metallic matrix and the cutting action relies on the matrix to slowly wear during the drilling, so as to expose more diamonds. Advancing the drill by rotary action causes a core to be extracted.

Figure 4:
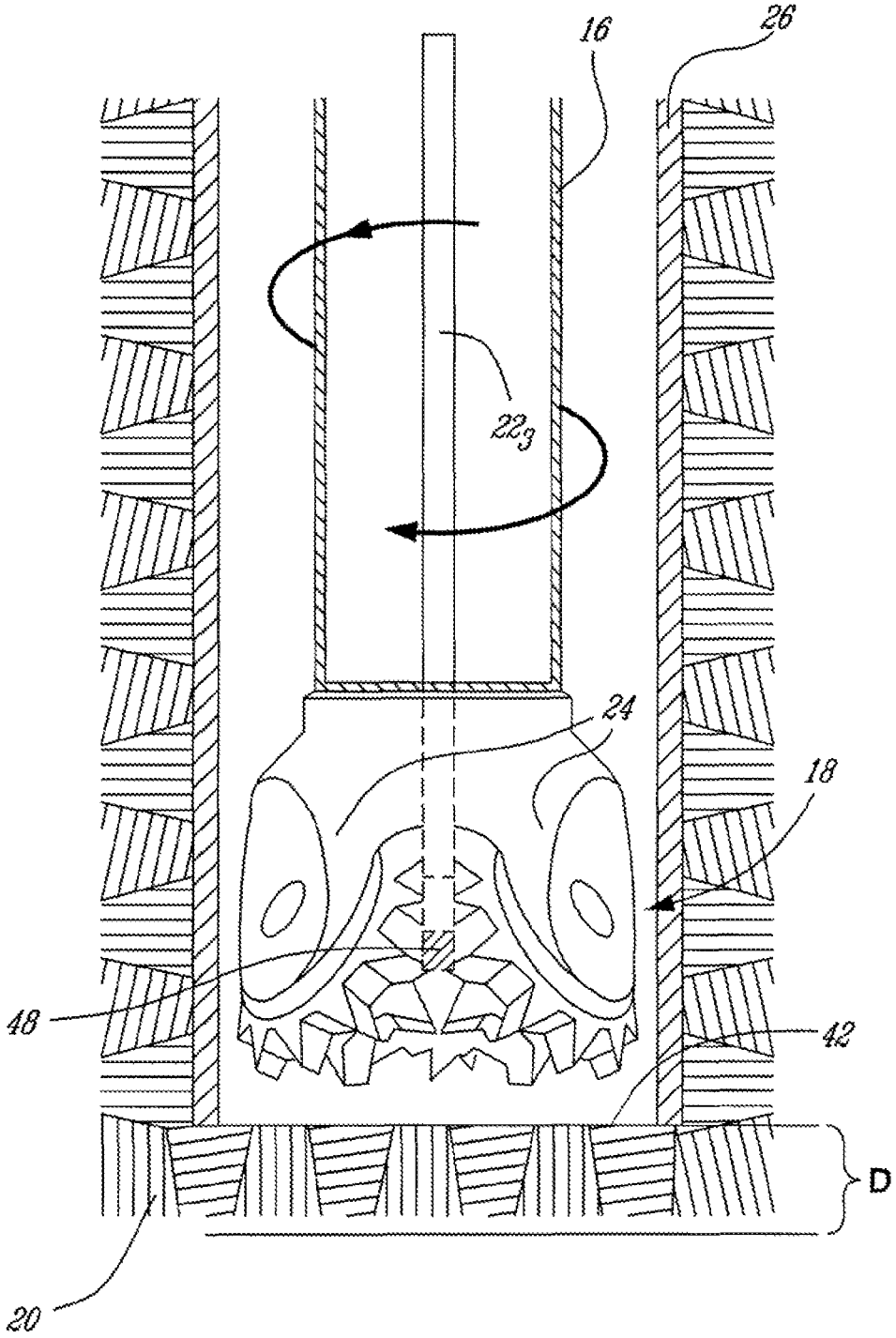
FIG. 4 shows a detailed side plan view of an excavation bit in accordance with an illustrative embodiment of the present invention.

Now referring to FIG. 4, and in accordance with a first illustrative embodiment of the present invention, electromagnetic energy is directed to the bottom surface 42 of the shaft 26 using a microwave antenna 48. The antenna 48 is positioned proximate to the cutting heads 24 and thus opposite the aggregate 20 located at the bottom of the shaft 26 and subsequently to be excavated by the cutting heads 24. Of note is that a three cone rock bit has illustratively been chosen as spaces are provided between the cutting heads 24 to allow for the introduction of drilling fluid and/or compressed air in order to simplify removal of rock chips, dust and other debris, as described herein above. The spaces between the cutting heads 24 also provide gaps which can accommodate the antenna 48. By positioning the antenna 48 proximate to the cutting heads 24, the electromagnetic energy can be focussed only on the portion of aggregate 20 which is about to be excavated thereby reducing the amount of electromagnetic energy which might otherwise be expended by irradiating rock which is not subsequently excavated or, as will be discussed in more detail below, irradiating rock with insufficient electromagnetic energy to induce the required thermal expansion in the aggregate/rock.

Still referring to FIG. 4, in order for the microwaves to directly irradiate the rock being drilled, the antenna 48 is located at the bottom of the excavation bit 18 with the coaxial cable 22 passing through it. Illustratively, the excavation bit 18 houses the antenna 48, which may be positioned on the periphery of the excavation bit 18 so as to maximize microwave radiation coverage. Indeed, as it is desirable for the co-axial cable 22 to be fixed relative to the excavation bit 18 (i.e. move along with it), the antenna 48 can be positioned off the excavation bit's center. In this manner, as the excavation bit 18 rotates, the antenna 48 moves around the center of rotation for direct coverage of a greater area of the rock surface. Further, when positioned in this manner, the antenna 48 interferes much less with the position and structure of the cutting heads 24. In order to impede the excavation bit 18 as little as possible, it is desirable for the microwave antenna 48 to be as small as possible. Still, it is also desirable to optimize the antenna's geometry in order to maximize the amount of microwave energy it emits towards the aggregate 20, thus impacting the antenna design as well.

In order to prevent the potentially dangerous microwaves emitted by the microwave assembly 12 from leaking out of the shaft 26 and into the surrounding environment, a safety box (not shown) could be used to enclose the components of the drilling assembly 14. Although a safety box enclosing all the components would be the simplest solution, this would eliminate access to the drilling components while the system 10 is in operation. Also, all components would be subject to microwave energy, which is not desirable. In addition, such a design would necessitate the use of additional material, thus proving costly. Another option would be to use a bottomless box resting on the floor outside the shaft 26. However, relatively large gaps, through which microwaves could escape, would be expected in this case. Alternatively, a box resting on the flat surface of the slab of rock 20 to be drilled could be used. In this case, it would be desirable to use a box small enough to rest on the rock slab, yet large enough to contain a significant amount of rock debris. Illustratively, the top of the safety box would have a hole surrounding the drill rod 16, thus allowing for motion (rotary and vertical) of the latter. In order to prevent leakage of microwaves, a microwave-reflective material could also be used to close the gap between the inner edge of the hole and the drill rod 16. Since a drilling fluid is circulated through the drill rod 16 and excavation bit 18 to bring the rock debris to the surface, it is also desirable for the safety box be fixed in place and to comprise air escape holes. Preferably, to prevent the microwaves from passing through them, the holes would have a diameter smaller than the microwave's wavelength. For the operating frequency of 2.45 GHz, holes of few millimeters in diameter would prove sufficiently small for example.

Figure 5:
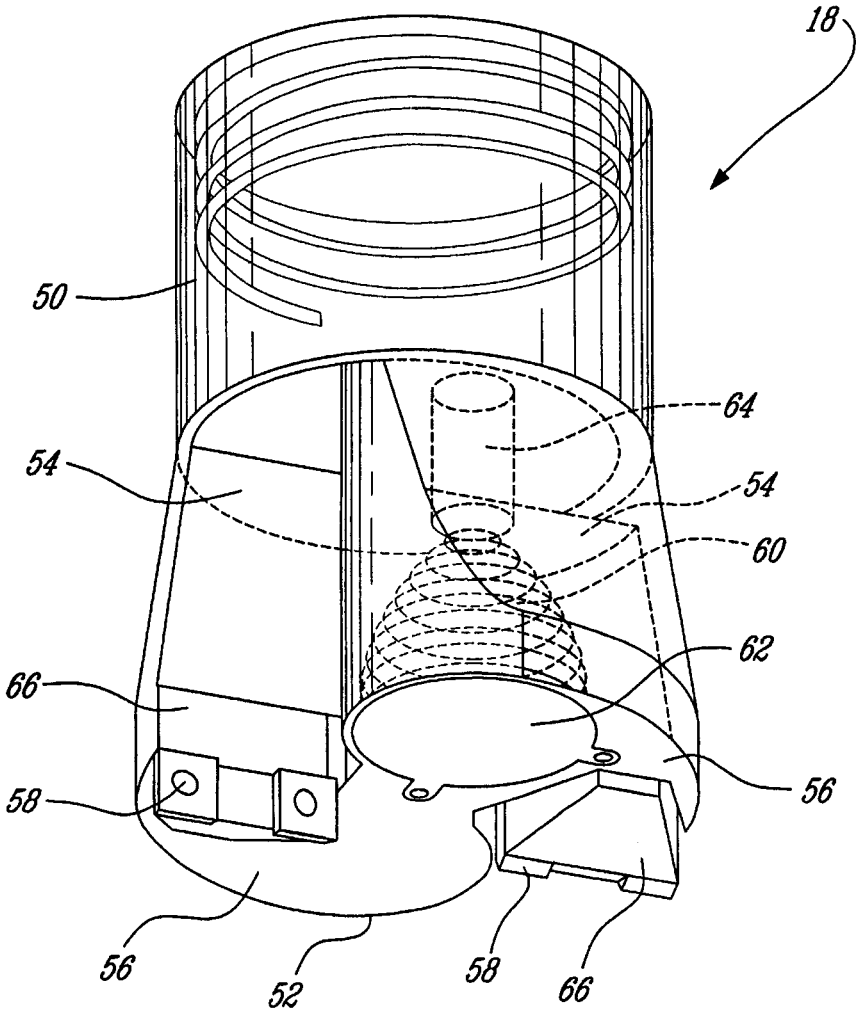
FIG. 5 shows a semi-transparent perspective view of an excavation bit in accordance with an alternative illustrative embodiment of the present invention.

Referring now to FIG. 5 in addition to FIG. 1 and in accordance with an alternative illustrative embodiment of the present invention, the aggregate 20 may be excavated by an excavation bit 18 having a drag geometry. Although drag bits are not normally used for the hard rock 20 intended to be drilled (as mentioned herein above), it is assumed that the rock 20 will be sufficiently softened by the microwaves emitted by the microwave assembly 12 so as to allow for successful drilling. The drill feed rate could thus be adjusted to allow sufficient time for the microwaves to reduce the rock's strength to the point where the excavation bit 18 would not be subject to undue or abnormal stresses, which otherwise could lead to permanent deformation or fracture.

Still referring to FIG. 5 in addition to FIG. 1, the drag bit 18 illustratively comprises a tapered base body 50 having a threaded upper end, which is attached to the drill rod 16, and a lower end defining the bit's cutting surface 52, which enters into contact with the aggregate 20. Tapering of the base body 50 ensures that a greater cutting surface area is created at the cutting end 52. In order to ease removal of rock chips from the cutting surface 52, sections 54 of the base body 50 were sliced away, thus allowing passage on the outside of the excavation bit 18. The base body 50 thus machined defines two wings 56, on which cutting tools 58 are attached near the cutting surface 52. The two-winged drag bit geometry has the advantage of allowing for a simple balanced design, which reduces vibrations and structural failure. Such a geometry also provides a fairly large amount of space between the wings 56, thus leaving ample room for rock chip clearing and for the antenna structure. In this regard, the base body 50 further comprises a housing 60 for the antenna 48, the housing 60 having a slot for a covering as in 62 (discussed in further detail herein below), which may be attached to the housing 60 by bolts, screws, and the like (not shown). In order to house the coaxial cable $\mathbf{22}_3$, an opening 64 is also machined into the base body 50 at the end of the housing 60, which will be closest to the drill rod 16.

Still referring to FIG. 5 in addition to FIG. 1, the cutting tools 58 illustratively comprise threaded holes (not shown), which allow them to be securely mounted as inserts on cutting tool holders 66 via screws of the like (not shown). The cutting tool holders 66 also comprise holes (not shown) for attachment to the base body 50 via machine screws or the like (not shown). The geometry of the cutting tools 58 was carefully designed since it is known in the art to improve the cutting force of the excavation bit 18 while ensuring that relatively smooth rock chips, which will be easily flushed away by a flow of fluid, are formed. Because it is desirable for the cutting tool inserts 58 to withstand highly abrasive conditions and handle cutting of hard substances, a material (e.g. tungsten carbide) with high strength and cutting properties was chosen. Moreover, to provide for a more flexible excavation bit 18, the cutting tool inserts 58 were illustratively designed to be replaceable. It will be apparent to a person having ordinary skill in the art that although costs and machining time may be decreased by using fewer inserts 58, greater wear will likely result, requiring the cutting operation to be performed slower. The number of cutting tool inserts 58 should therefore be chosen according to design considerations.

Figure 6A:
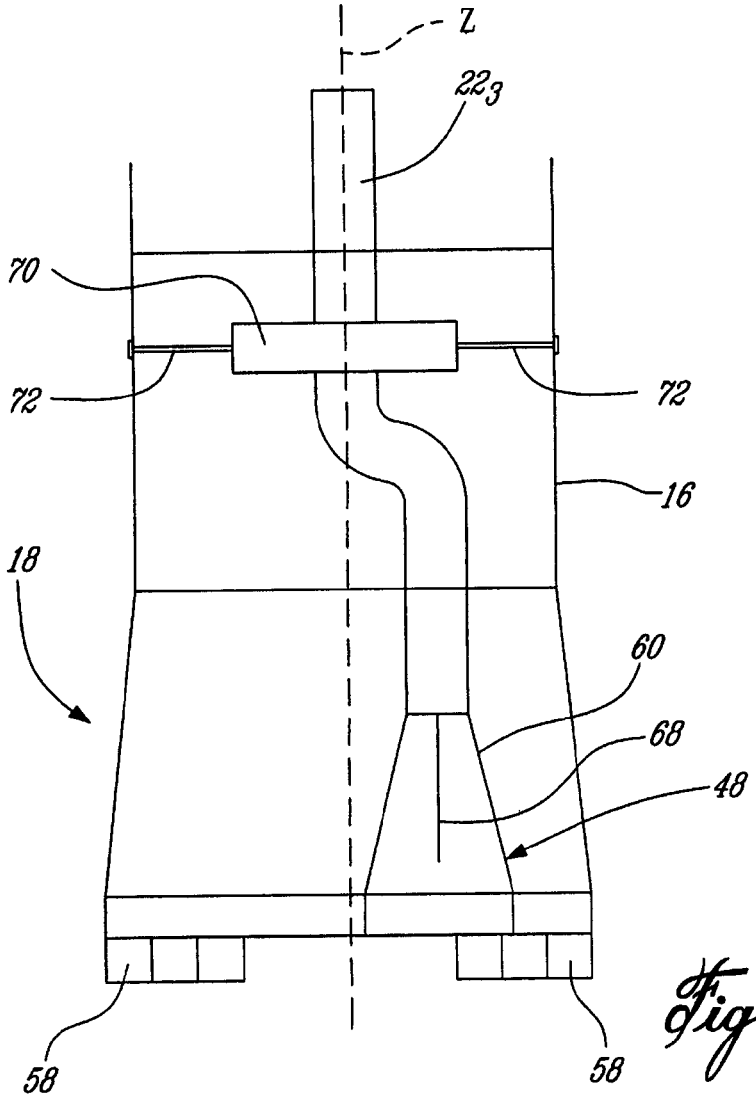
FIGS. 6(*a*) and 6(*b*) show a front plan view and a bottom plan view in accordance with an alternative illustrative embodiment of the present invention.
Figure 6B:
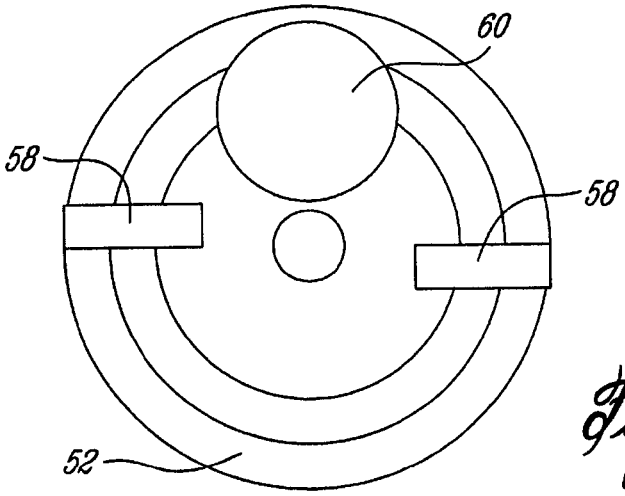

Referring now to FIGS. 6(*a*) and 6(*b*), for rotary-type excavation bits, such as rotary bits and rotary drag bits, the antenna 48 is illustratively designed as a horn antenna. For these types of bits, the horn antenna design is easier to implement as the space between the cutting tools 58 enables to accommodate a bigger-sized antenna opening. Indeed, the increased space allows the microwave beam directed by the antenna 48 to widen enough to cover sufficient area of the rock ahead of the cutting tool 58. To design the horn antenna 48 and for sake of simplicity, the coaxial cable 22 is stripped down to the inner conductor 68 for a quarter of the microwave wavelength (i.e. 30.6 mm).

Referring now to FIGS. 6(*a*) and 6(*b*) in addition to FIG. 5, as known in the art, such an antenna 48 emits most of the electromagnetic waves radially with only a small portion being emitted vertically towards the rock surface. Thus, in order to ensure that the emitted microwaves are directed towards the rock surface and thus reduce power losses as well as shield the antenna 48 from being damaged by the removed rock, it is desirable to enclose the antenna 48 in a surrounding structure. Although commercial antennas are available to efficiently terminate coaxial cables and direct the microwave energy outwards, they tend to be too large to meet the size requirements of the excavation bit 18 (illustratively of 8 cm diameter). The conical reflector (or housing) 60 is thus machined directly into the excavation bit 18 to surround the stripped conductor 68. The dimensions of the housing 60 are chosen, such that electromagnetic energy emitted by the conductor 68 bounces off the walls of the housing 60 and into the drilling environment, as opposed to back to the stripped conductor 68 and up the coaxial cable 22. It is also desirable for the housing 60 to leave sufficient space for the wings 56 of the excavation bit 18. As a result, the conical housing 60 is machined within the base body 50 of the excavation bit 18 with a diameter no more than half the overall excavation bit diameter.

It is further desirable to manufacture the inner walls of the housing 60 with a microwave-transparent material, which ensures that the microwaves emitted by the antenna 48 are reflected towards the rock to be excavated. The conical cavity of the housing 60 is also filled with the same microwave-transparent material in order to stabilise the antenna while ensuring proper transmission of the electromagnetic energy towards the rock being excavated. Quartz and Teflon® are microwave-transparent materials commonly used in the art. As Teflon® is less brittle than quartz, it is easier to machine and less liable to crack or break in the harsh drilling environment. In addition, Teflon® is low in price so it was therefore used in the design illustrated in FIG. 6 to fill the conical cavity of the housing 60. A Teflon® cover plate 62 was also illustratively placed over the aperture of the housing 60 to further shield the antenna 48 from being damaged by the removed rock.

Referring now to FIG. 2 in addition to FIGS. 6(*a*) and 6(*b*), although the coaxial cable $\mathbf{22}_3$ is concentric with the axis of rotation Z of the drill rod 16 as it emerges from the swivel 38, it is illustratively positioned to the side before it is fed into the antenna 48. As discussed above, this allows the antenna 48 to be positioned off-center from the drill rod's axis of rotation Z. For this purpose, the cable 22 is illustratively held into position in the center of the drill rod 16 by a brace 70 or the like, after which it is bent (for semi-rigid style cables) and fed through the bit 18 such that the stripped end 68 sits in the conical housing 60. As illustrated in FIG. 6, the bottom of the drill rod 16 is selected as the bend point, although other bend locations are equally viable. The brace 70 could be fixed in place by screws 72 passing through the wall of the drill rod 16. Although, a protective casing (e.g. circular metal tubing) (not shown) could illustratively be included around the coaxial cable 22 to prevent it from experiencing any bending forces induced by the high-pressure airflow, it is sufficient (and simpler) to solely brace the coaxial cable 22.

Referring now to FIGS. 7(*a*) and 7(*b*) in addition to FIGS. 6(*a*) and 6(*b*), an alternative antenna design may be used for excavation bits other than rotary and rotary drag bits, such as diamond and percussion bits. In this regard, the microwave antenna design is adapted to the geometry of the excavation bit 18. For bit types other than rotary and rotary drag, the cutting surface of the excavation bit 18 typically has a flatter geometry with more cutting tools 58 covering a wider portion of the excavation bit's cutting surface. As a result, it is desirable for the antenna design to fit within such narrower cutting surfaces. Moreover, the design of these bits makes the space between the excavation bit 18 and the rock face much smaller. The horn antenna design described herein above would therefore be much closer to the rock face, thus requiring a wider opening in order to ensure that the antenna 48 covers enough rock area and such a design would thus be difficult to accommodate without being detrimental to the geometry of the bit's cutting surface 52.

Figure 7A:
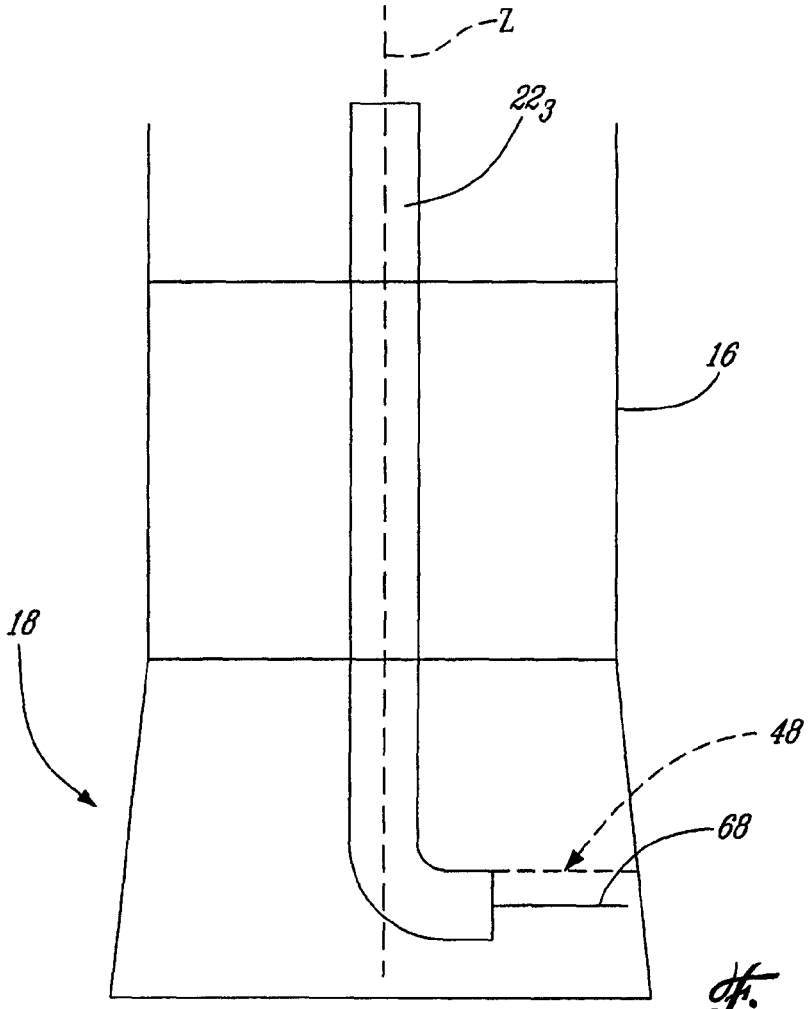
FIGS. 7(*a*) and 7(*b*) show plan of an electromagnetic energy assisted mining system in accordance with another alternative illustrative embodiment of the present invention.
Figure 7B:
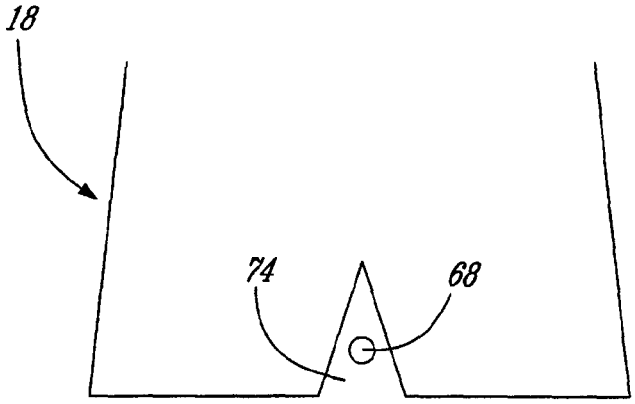

Still referring to FIGS. 7(*a*) and 7(*b*), the antenna 48 is illustratively designed as a slotted antenna, in which a V shaped notch 74 (FIG. 7*b*) is machined into the face of the excavation bit 18. The coaxial cable 22 is then stripped down to its inner conductor 68 for a quarter of the microwave wavelength (i.e. 30.6 mm), bent and inserted into the notch 74 to create the slotted antenna 48 (FIG. 7*a*) where the notch 74 acts as a reflector to direct microwave emissions towards the rock. The notch cavity is illustratively filled with a microwave-transparent material, as is the case of the alternate design, to avoid blocking the emitted microwaves. Such a thin line design would cover enough rock face area while still being advantageously accommodated within the design of the bit's cutting surface. The slotted antenna design also ensures that the distance of separation between the antenna 48 and the rock to be excavated by the excavation bit 18 remains small (e.g. in the order of millimetres). As known in the art, this is desirable in order to minimize power losses, especially when a drilling fluid other than air is used.

Referring back to FIG. 4 and as discussed briefly hereinabove, in order to improve the speed of excavation, reduce wear on the cutting heads 24, or both, electromagnetic energy of predetermined wavelength(s) is focussed on the layer of aggregate/rock immediately below the bottom surface 42 of the shaft 26, illustratively to a depth D, in order to heat the aggregate 20 and induce thermal expansion sufficient to weaken the aggregate 20 prior to it being excavated by the cutting heads 26. Since the aggregate 20 illustratively comprises a heterogeneous mixture of materials suspended in a matrix, it would be useful to study the heating characteristics of these minerals in order to determine how they would be affected by electromagnetic energy they would be exposed to when the system 10 is in operation. As a result, it would be possible to predict what electromagnetic frequency would be best suited to induce thermal expansion of the aggregate 20, according to the materials present in the matrix.

As discussed briefly above, electromagnetic energy such as microwaves is a non-ionizing electromagnetic radiation with frequencies in the range of 300 Mhz to 300 GHz. These frequencies include 3 bands: the ultrahigh frequency (UHF, 300 MHz to 3 GHz), the super high frequency (SHF, 3 GHz to 30 GHz) and extremely high frequency (EHF, 30 GHz to 300 GHz). It is well known that electromagnetic energy have extensive applications in communication. However, the industrial application of electromagnetic energy for heating was suggested in the forties when the magnetron was developed. It was finally implemented in the fifties after the extensive work on material properties. Four microwave frequencies have been designated for Industrial, Scientific and Medical applications (ISMI): 915 MHz, 2.45 GHz, 5.8 GHz and 22.125 GHz. When microwaves are studied as a source of energy they are immediately linked to the heating of dielectric materials.

Electromagnetic energy such as microwaves causes molecular motion by migration of ionic species and/or rotation of dipolar species. Heating a material with electromagnetic energy depends to a great extent on its dissipation factor, that is the ratio of the dielectric loss or loss factor to dielectric constant, of the material. The dielectric constant is a measure of the ability of the material to retard electromagnetic energy as it passes through: loss factor is a measure of the ability of the material to dissipate energy. In other words, loss factor represents the amount of input electromagnetic energy that is lost in the material by being dissipated as heat. Therefore, a material with high loss factor is easily heated by electromagnetic energy.

All the materials can be classified into one of the three groups, that is conductors, insulators and absorbers. In particular electromagnetic energy is reflected from the surface of, and therefore does not heat, metals. Metals in general have high conductivity and are classified as conductors and are often used as conduits (waveguides) for the electromagnetic energy. Materials which are transparent to electromagnetic energy are classified as insulators and are often used to support the material to be heated. Materials which are absorbers of electromagnetic energy are easily heated and are classified as dielectrics.

The advantages of electromagnetic energy heating over conventional heating are well known in the art and include:

Non-contact heating;

Energy transfer and not heat transfer;

Rapid heating;

Material selective heating;

Volumetric heating;

Quick start up and stopping;

Heating starts from the interior of the material body; and

High level of safety and automation.

Referring now to TABLE 1 varying heating characteristics have been observed in different minerals exposed to electromagnetic energy (illustratively microwave energy at a frequency of 2.45 GHz):

TABLE 1

| Mineral | Heating Response |
|---|---|
| Arsenopyrite | Heats, some sparking |
| Bornite | Heats readily |
| Chalcopyrite | Heats readily, sulphur fumes |
| Covellite | Difficult to heat |
| Galena | Heats readily with arcing |
| Pyrite | Heats readily |
| Pyrrohtite | Heats readily |
| Cassiterite | Heats readily |
| Hematite | Heats readily |
| Magnetite | Heats readily |
| Monazite | Does not heat |

Similarly, when a variety of materials are subject to electromagnetic energy supplied by a 1 kW 2.45 GHz source, the maximum temperatures for the given heating duration as tabled in TABLE 2 were observed:

TABLE 2

| Mineral | Maximum temp (° C.) | Time (min) |
|---|---|---|
| Albite | 69 | 7 |
| Chalcocite | 746 | 7 |
| Chalcopyrite | 920 | 1 |
| Chromite | 155 | 7 |
| Cinnabar | 144 | 8.5 |
| Galena | 956 | 7 |
| Hematite | 182 | 7 |
| Magnetite | 1258 | 2.75 |
| Marble | 74 | 4.25 |
| Molybdenite | 192 | 7 |
| Orthoclase | 67 | 7 |
| Pyrite | 1019 | 6.75 |
| Pyrrohtite | 586 | 1.75 |
| Quartz | 79 | 7 |
| Sphalerite | 88 | 7 |
| Tetrahedrite | 151 | 7 |
| Zircon | 52 | 7 |

A number of important conclusions can be drawn from the above:

Highest temperatures were obtained with carbon and most metal oxides.

Most metal sulphides heat well with a consistent pattern. Metal powders and some heavy metal halides also heat well.

Gangue minerals such as quartz, calcite and feldspar do not heat.

Most silicates, carbonates, sulphates, some oxides and sulphides do not heat well and their mineral properties remain essentially the same.

Low lossy materials such as SiO2 and CaCO3 heat only very slowly; and

High lossy materials such as PbS, and Fe3O4 heat rapidly.

Additionally, it has also been found that ores having consistent mineralogy and which contain a good absorber of electromagnetic energy in a transparent gangue matrix are more responsive to treatment with electromagnetic energy. Additionally, ores that contain small, finely disseminated particles in discrete elements respond poorly to treatment with electromagnetic energy.

Breaking rocks using electromagnetic energy is primarily based on inducing stresses by differential thermal expansion and is based on a principle similar to fire setting technique. From the above it follows, therefore, that heating an aggregate such as rock, which is comprised of a heterogeneous mixture of materials such as minerals suspended in a matrix, electromagnetic energy, causes the different materials within the aggregate to heat at different rates (for example, as discussed above the metals in metal bearing rocks, or ores, tend to remain cool while reflecting heat into the surrounding materials, thereby increasing this effect). As a result, and as aggregate materials such as rocks (although typically of high compressive strength) have relatively low tensile strengths, even relatively small thermally induced expansion of one material in the aggregate can serve to introduce micro cracks into or fracture the aggregate.

The complex permittivity of a material defines the interaction of the material with electromagnetic energy (or electromagnetic waves), determines how the material interacts with the electromagnetic energy and is sensitive to changes in frequency. When the complex permittivity is normalized with respect to the constant permittivity of the vacuum $\epsilon_0$ (8.854×10-12 F/m) it is termed as the complex relative permittivity $\epsilon_r$.

$$\epsilon_r = \epsilon' - j\epsilon'' \quad (1)$$

$$\tan(\delta) = \epsilon''/\epsilon' \quad (2)$$

where:

$\epsilon_r$=complex relative permittivity;

$\epsilon'$=relative dielectric constant (referred to hereinafter simply as the dielectric constant);

$\epsilon''$=relative dielectric loss factor (referred to hereinafter simply as the loss factor); and tan(δ)=loss tangent.

The loss factor combines all forms of losses including polarization and conduction losses. The ratio of the real part to the imaginary part is called the loss tangent and can be used to characterize materials: in a low loss material $\epsilon''/\epsilon' \ll 1$, in a high loss material $\epsilon''/\epsilon' \gg 1$. When a material is much greater than 1 it is very much affected by electromagnetic energy. The dielectric constant $\epsilon'$ for rock forming minerals ranges between 3 and about 200, however most values are between 4 and 15. The loss factor $\epsilon''$ ranges between 0.001 and 50 and is sensitive to changes in frequency and temperature. Dielectric properties at 25° C. of various geotechnical related materials are given in TABLE 3.

TABLE 3

| Material | $\epsilon'$ | $\epsilon''$ |
|---|---|---|
| Andesite, Hornblende | 5.1 | 0.03 |
| Basalt (9 types) | 5.4-9.4 | 0.08-0.88 |
| Gabbro | 7 | 0.13 |
| Granite | 5-5.8 | 0.3-0.2 |
| Muscovite | 5.4 | 0.0016 |
| Marble | 8.7 | 0.14 |
| Obsedian | 5.5-6.6 | 0.1-0.2 |
| Tuff | 2.6-5.8 | 0.04-0.36 |

TABLE 3-continued

| Material | ε' | ε" |
|---|---|---|
| Pumice | 2.5 | 0.03 |
| Sandy Soil Dry | 2.55 | 0.016 |
| Water | 76.7 | 12.04 |
| Ice pure | 3.2 | 0.003 |

Heating using electromagnetic energy such as microwaves involves the conversion of electromagnetic energy into heat. The amount of thermal energy deposited (power density) into a material due to electromagnetic energy heating is given by the equation:

$$P_d=2\pi f\epsilon_0\epsilon''E_i^2 \quad (3)$$

where:

$P_d$=Power dissipation density (W/m$^3$);

f=frequency of electromagnetic radiation in Hertz;

$\epsilon_0$=permittivity of free space ($8.854\times10^{-12}$ F/m);

ε"=relative dielectric loss factor; and $E_i$=electric field intensity within the dielectric material due to the electromagnetic power (V/m).

Some important features of the equation (1) are:

- The power density dissipated in the workload is proportional to the frequency where the other parameters are constant, which means the volume of the workload in the applicator can be reduced as the frequency rises, thereby allowing the use of a more compact applicator;
- the power density is proportional to the loss factor ε";
- for a constant power dissipation density the electric field intensity $E_i$ reduces with the root of the frequency f, which means that, if loss factor ε" remains constant with the frequency f, the risk of voltage breakdown is reduced as the chosen operating frequency f is increased, thus making it desirable to use higher frequencies.
- ε" typically varies with the frequency f especially in the materials where dipolar loss dominates. Generally ε" rises with frequency f adding to the effects (a) and (d);
- The electric field $E_i$ is typically not a constant but rather varies in space depending on the microwave applicators, the dielectric constant of the material being irradiated (ε') and the geometry of the material being irradiated;
- In practice the value of ε" varies not only with frequency f, but also with temperature, moisture content, physical state (solid or liquid) and composition of the material being irradiated; and
- In some cases, both ε" and $E_i$ should be considered as variables during the electromagnetic energy heating process.

In light of the above, it will now be apparent to a person of ordinary skill in the art that the heat induced using electromagnetic energy in the materials which combine to form an aggregate such as rock is determined by a number of factors including the frequency and power density of the electromagnetic energy as well as the length of exposure. Additionally, the thermal expansion sufficient to weaken the aggregate rock can vary depending not only on these features but also in relation to the speed at which one material within the aggregate expands relative to another. As a result, by selecting a frequency which increases the speed of thermal expansion of one material relative to another and/or by increasing the power density of the selected frequency, the application of electromagnetic energy to the aggregate can be optimised.

In order to better understand the thermal stresses which are induced in an aggregate by exposure to electromagnetic radiation a simulation was carried out using a finite element numerical model. Firstly, an electromagnetic analysis was performed to calculate the electric field within a dielectric load. Secondly, a transient thermal analysis was conducted to predict the temperature response of the dielectric load. Thirdly, a stress equilibrium calculation was done to estimate the resulting thermal stresses due to the microwave heating.

For the purpose of the analysis the dielectric load selected was limestone with sulphide mineral (Pyrite). This particular rock was selected as the dielectric load because of the availability of the thermal and electrical properties of the calcite and the pyrite phases of the limestone.

For the simulation, excitation in the form of a waveguide modal source was used. Here an input port and an output port were defined for the waveguide and the input port was excited with a harmonic frequency of 2.45 GHz. Three input power values of 150 W, 750 W and 1000 W were used for the present analysis for excitation source. The finite element model was solved for the harmonic analysis to get the electric field distribution within the dielectric load.

A transient thermal analysis was carried out as the next stage of analysis to simulate the temperature profiles for different microwave input power. In this regard, calcite has a very low value of dielectric loss factor and as a result microwave heating of the calcite was not included in the model, that is only heating of the pyrite phase was considered. For the calculation of the electromagnetic energy power dissipation density of the pyrite phase, electric fields within the dielectric load obtained from the high frequency electromagnetic analysis and the dielectric loss factor (ε") were used.

The simulation was geometrically and computationally simplified by considering a very small (4 mm diameter) hemispherical portion of the cylindrical rock (limestone). A single hemispherical pyrite particle of diameter 1 mm was considered, surrounded by a calcite host rock of diameter 4 mm. Additionally, the axial symmetry of the hemisphere allows the modeling in a two (2) dimensional domain. The material properties of the pyrite and calcite phases used in the simulation are provided in TABLE 4 and the calcite and pyrite were assumed to be perfectly bonded and initially at ambient temperature.

TABLE 4

| | Thermal Conductivity (W/m K) | | | Specific Heat capacity (J/Kg K) | | | |
|---|---|---|---|---|---|---|---|
| Mineral | 273° K | 373° K | 500° K | 298° K | 500° K | 1000° K | Density (kg/m3) |
| Calcite | 4.02 | 3.01 | 2.55 | 819 | 1051 | 1238 | 2680 |
| Pyrite | 37.90 | 20.50 | 17 | 517 | 600 | 684 | 5018 |

The thermal behaviour of the model can be described by the following equations:

$$\rho cp(\partial T/\partial t)=1/r\partial/\partial r(kr\partial T/\partial r)+\partial/\partial z(k\partial T/\partial z)+Pd \quad (4)$$

where:

T=temperature in ° K;

r and z are spatial coordinates in millimetres;

t=time in seconds;

ρ=density in Kg/m$^3$;

Cp=specific heat capacity in J/Kg K;

K=thermal conductivity in W/m K; and

Pd=volumetric heat source term due to the electromagnetic radiation (W/m$^3$) calculated from equation (1).

Thermal stresses due to the differential microwave heating were extracted for various microwave power absorption densities and time intervals using the following methodology. The analysis was stepped in to the coupled field mode and the temperature field obtained as a result from the transient thermal analysis was input as the load and the resulting thermal stresses were calculated assuming a linear elastic model for the pyrite and calcite phases. The stress strain relationship to cover the thermal strains and stresses were combined with equations of equilibrium for a isotropic material to predict the thermal response of the model as follows:

$$\epsilon_{rr}=1/E\{\sigma_{rr}-\nu(\sigma_{\theta\theta}+\sigma_{zz})\}+\alpha T \quad (5)$$

$$\epsilon_{\theta\theta}=1/E\{\sigma_{\theta\theta}-\nu(\sigma_{rr}+\sigma_{zz})\}+\alpha T \quad (6)$$

$$\epsilon_{zz}=1/E\{\sigma_{zz}-\nu(\sigma_{\theta\theta}+\sigma_{rr})\}+\alpha T \quad (7)$$

$$\partial\sigma_{rr}/\partial r+\partial\tau_{rz}/\partial z+(\sigma_{rr}-\sigma_{\theta\theta})/r=0 \quad (8)$$

$$\partial\tau_{rz}/\partial r+\partial\sigma_{zz}/\partial z+\tau_{rz}/r=0 \quad (9)$$

where:

$\epsilon_{ij}$, $\sigma_{ij}$ $\tau_{ij}$ are strains, normal stresses and shear stresses in index notation with i and j representing the indices represented by the three (3) different spatial coordinates r and z.

As the analysis was stepped in to a coupled field mode, the geometry and mesh properties of the model remained the same as in the transient thermal analysis but with the exception that the elements were changed to two dimensional structural element. The material was assumed to behave as a linear isotropic elastic medium with mechanical properties determined by the Elastic modulus and Poisson's ratio using the values found in TABLE 5.

TABLE 5

| | Strength Properties | | | | | |
|---|---|---|---|---|---|---|
| | Young's Modulus | Poisson's | Thermal Coefficient of Expansion (1/K) | | | |
| Mineral | (Gpa) | Ratio | 373 K | 473 K | 673 K | 873 K |
| Calcite | 797 | 0.32 | $13.1\times10^{-6}$ | $15.8\times10^{-6}$ | $20.1\times10^{-6}$ | $24\times10^{-6}$ |
| Pyrite | 292 | 0.16 | $27.3\times10^{-6}$ | $27.3\times10^{-6}$ | $33.9\times10^{-6}$ | — |

The results of the high frequency electromagnetic simulation are tabled in TABLE 6.

TABLE 6

| Microwave Input power at 2.45 GHz (in Watts) | Maximum electric field intensity within the Dielectric (Ei in Volts/cm) |
|---|---|
| 150 | 126.79 |
| 750 | 283.51 |
| 1000 | 327.37 |

It can be seen using Maxwell's equations that the electric field intensity is a function of number of variables such as the geometry of the load, geometry of the applicator, the dielectric constant of the load and the input microwave power. Modifying one or more of these variables can lead to a change in the electric field intensity. In the simulation it was assumed that the impedance of the load is perfectly matched with that of the waveguide, and hence the values of the electric field intensity are slightly higher than that which might be obtained in an actual microwave cavity.

The microwave power absorption densities of the pyrite phase at increasing electromagnetic energy input powers can also be observed.

The value of maximum electric field intensity obtained from the high frequency electromagnetic analysis was used for the computation of microwave power absorption density ($W/m^3$) from equation (1) for different electromagnetic energy power levels of 150 W, 750 W and 1000 W as a function of temperature. It was shown that microwave power absorption density follows the same trend as the dielectric loss factor and has a linearly increasing trend with temperature up to 600° K and beyond that the power absorption density is a constant. This trend indicates that as the temperature of the load increases, the ability of the load to dissipate electromagnetic energy into heat also increases which results in a higher rate of temperature increase within the dielectric load.

Transient temperature distributions as a result of heating at increasing input powers can be observed as well. Results indicate that at longer exposure to electromagnetic energy, higher peak temperatures were obtained. In particular, it can be seen that the pyrite phase requires about 60 seconds to reach a temperature of 400° K with an input power of 150 W at 2.45 GHz. It can also be seen that just 5 seconds are required to reach the same temperature when the input power is 1000 W. As a result, it is readily apparent that the microwave power density has a large influence on the increase in temperature. Additionally, it is apparent from the results that as the input power increases, so does the temperature gradient between the pyrite and calcite phases. This is due to the lower exposure time and higher input power providing less time for the heat to diffuse into the calcite phase. The results also indicated that the temperature gradient across the pyrite and calcite phases increases as the duration of exposure to electromagnetic energy increases. This effect is more evident when individual plots are examined more closely. Indeed, it can be seen that for an input power of 750 W, the temperature gradient across the pyrite and calcite is 34K for a duration of 10 seconds and 63K for a duration of 60 seconds.

Simulation results for the thermal stress profile for varying input powers further indicate that within the pyrite phase a state of compressive stress exists and the stress state changes to tensile just near the calcite/pyrite interface.

For the same input microwave power it can be seen that as the time of exposure is increased the stresses also increase likewise due to the higher energy deposition rate. For the same duration of exposure, higher stress gradients are obtained at the calcite/pyrite interface at higher input powers. Comparing detailed individual plots, it can be seen that for the same time of exposure of 10 seconds, a tensile stress of 400 MPa is obtained for 1000 W microwave input power whereas a tensile stress of 250 MPa is obtained for a power input of 750 W. It can also be seen that the magnitudes of compressive stresses within the pyrite phase do not exceed the overall unconfined strength of the rock. Typically unconfined compressive strength of limestone is in the range of 125 to 130 MPa. However the tensile strength at the interface of calcite and pyrite exceeds the tensile strength of the rock, which for a limestone is substantially lower than the unconfined compressive strength. This trend shows that substantial damage occurs at the interface rather than within the individual mineral phases. Even at a low input power of 150 W, a peak tensile stress of 200 MPa is predicted near the interface indicating that low power electromagnetic energy can in fact induce sufficient thermal stresses to fracture the rock. The thermal damage induced from low power electromagnetic energy would be even more pronounced where both electromagnetic energy responsive and electromagnetic energy non-responsive mineral phases are present within a rock, as this creates a thermal mismatch between the different responsive and non-responsive mineral phases thereby creating stresses of a magnitude sufficient to induce damage at the grain boundaries.

In addition to the above simulations, the impact of low power microwaves (~100 to ~150 W) on Basalt was studied. Basalt was selected as the test specimen for the study because it is one of the hardest and most common igneous rocks and occurs with abundance on the surface of earth. Drilling or excavating such rocks is still a challenge.

The objective of the experiments were set at determining the temperature rise in the rock at different time intervals for a constant input of microwave power and determine the strength of the microwaved specimens using simple point load testing.

The point load test is a standard test method suggested by ISRM (1973) to determine the point load strength index. In essence, point load testing involves compressing a piece of rock between two points. Point-load index is calculated as the ratio of the applied load P to the square of the distance D between the loading points. Rock samples in different shapes such as core, block, and irregular lumps can be tested by this method and it is also applicable to hard rock with compressive strength above 15 MPa.

Uncorrected Point Load Stress Index, ls, is calculated as:

$$ls=P/De2(\text{MPa}) \tag{10}$$

where:

P=failure load (obtained by multiplying the hydraulic pressure at failure with the effective ram area, if the failure load is calibrated in terms of hydraulic pressure)

De=equivalent core diameter ls varies as a function of De, therefore a size correction must be applied to obtain a unique point load strength value for the rock sample. The size corrected point load strength index, ls (50), of a rock specimen is defined as the value of ls that would have been measured by a diametral test with D=50 mm.

The size correction was obtained using the formula:

$$ls(50)=F\cdot ls \tag{11}$$

The "Size Correction Factor F" can be obtained from the Size Correction Factor chart (ASTM 1991) or from the expression:

$$F=(De/50)0.45 \tag{12}$$

The uniaxial compressive strength can then be estimated by using the Size Correction Factor chart or the following formula:

$$\sigma c=Cls(50) \tag{13}$$

where:

σc=uniaxial compressive strength

C=factor that depends on site-specific correlation between σc and ls(50)

ls(50)=corrected point load strength index

The values for C can be obtained from TABLE 7

TABLE 7

| Core Size (mm) | Value of "C" (Generalized) |
|---|---|
| 20 | 17.5 |
| 30 | 19 |
| 40 | 21 |
| 50 | 23 |
| 54 | 24 |
| 60 | 24.5 |

The Experimental apparatus used for this study was a standard batch type microwave dryer and a standard point load tester.

The microwaving setup consists of a microwave generator (750 W and 2.45 GHz), 3 port circulator, 3 stub tuners and a cavity (dimensions of 40 cm×35 cm×25 cm). The microwave generator has the capability of variable power operation with continuous microwave power output. The microwaves generated are transmitted to the main cavity through a series of rectangular waveguides. A 3-port circulator ensures that the microwaves reflected from the cavity are directed to the dummy load where the reflected microwaves are absorbed. Reflected and incident powers were monitored by the power meters integral with the microwave generator. The reflected microwave power was maintained at a near zero value during each run by manually adjusting a three stub tuner inserted at the top of the waveguide assembly. A standard infrared camera was used for the purposes of temperature measurements.

A standard portable point load-testing machine was used to test the irradiated samples. The unit consists of loading platens, loading system (ram and loading frame) and a pressure gauge. The point load tester uses a high-pressure hydraulic ram with a small hydraulic pump as the loading system. The loading platen consists of a set of hardened steel cones with a radius of curvature of 5 mm and an angle of cone equal to 60°. Load is measured by monitoring the hydraulic pressure in the jack by means of the pressure gauge. Specimens up to 100 mm in diameter can be used. A sliding crosshead and steel pins allows for quick adjustment of clearance. The maximum capacity of the point load tester is 5 tons.

The test specimens of Basalt in the form of uncut lumps were obtained from a quarry in New Jersey County, USA. The uncut samples were suitably cored using a diamond-coring bit into long cylindrical specimens with a diameter of 38.1 mm (1.5 inches). These specimens were later cut to obtain a L/D>1, L being the length of the specimen. A diamond band saw was used for the purpose. A total of 35 specimens were cored from the Basalt lumps.

The Basalt texture consists of large crystals of olivine, augite, pyroxene and plagioclase minerals set in fine crystalline or glassy matrix in addition to some iron oxides. Megascopic and microscopic description of the specimen used for the present study is provided in TABLE 8.

TABLE 8

| Megascopic description of the rock | Microscopic Description |
|---|---|
| A greenish-black rock with aphanitic structure and local red bands due to iron oxide stains | Microphenocrysts of augite (some glomeroporhyritic) are set in a matrix of thin laths of labrodarite, granular clinopyroxene and dark; essentially opaques glass which subordinate and interstitial (interstitial texture). Some of the glass been altered to a brown, iron rich chlorite: some of the plagioclase to sericite.skeletal magnetite is a widespread accessory. |

The rock specimens were divided into five (5) sets with each set containing seven (7) specimens. One set of specimens (termed the control specimens) were not exposed to microwave radiation in order to constitute the control specimens. The remaining four (4) sets of specimens were used for the microwave studies. Each set of specimens was exposed to different time intervals of microwave radiation.

A lower power density of 1 W/gram and time intervals for the exposure of 60 seconds, 120 seconds, 180 seconds, and 360 seconds were selected.

The experimental procedure was as follows:

a. The mass of the cylindrical rock specimens were determined using an electronic balance with an accuracy of ±0.01. Their average weight was 140 g.
b. Water in a glass container weighing approximately the same as rock specimens was then placed in the microwave cavity on a one-inch Teflon stand and the generator was switched on. This was done to fine tune the reflected microwave power to a zero value. After tuning the reflected microwave power to zero the water in the cavity was removed before the start of the experimental runs.
c. A rock specimen was then placed in the microwave cavity on the Teflon stand and its position inside the cavity was adjusted in such a way to get the least reflected power. The position of least reflected power was then marked off in order to place all the rock specimens at the same position of minimum reflected power.
d. Rock samples were then placed in the cavity one at a time and then the generator was switched on. The Power input was kept at 1 W/g. Seven replicates were used for each time interval. The time of exposure for the sample sets is as shown in TABLE 9.
e. Temperature measurements of the rock specimens were taken before and after the microwave exposure using an infrared camera. Temperature was measured at different positions on the specimens and an average temperature was recorded.
f. Later the samples were placed in a steel crucible and were allowed to cool down to room temperature under ambient conditions.

The duration of exposure of the samples of the different sets is provided in TABLE 9.

TABLE 9

| Sample set | Time of exposure (in seconds) |
|---|---|
| Set I | 60 |
| Set2 | 120 |
| Set3 | 180 |
| Set4 | 360 |

For the present work diametral testing of the control and microwaved samples were carried out. For the diametral point load testing the load is applied to the specimen.

The testing procedure was as follows:

1. The rock specimens were inserted into the test device and the platens closed to make contact along the core diameter. It was ensured that the distance L between the contact points and the nearest free end is at least 0.5 times the core diameter.
2. The sample was loaded steadily using the hydraulic hand loading system until failure occurred. Hydraulic pressure at failure was recorded.
3. The procedure was repeated for all the samples.
4. The uncorrected point load index, corrected point load index and the compressive strength of the rock specimens were determined following the procedure discussed above.

The variation of temperature with different microwave exposure times at a constant microwave power density of 1 W/gram shows that there is a steady increase in the temperature roughly at a rate of 287 K (14° C.) per minute. The highest average temperature obtained was 374K (101° C.) at an exposure time of 360 s. Temperatures up to 388K (115° C.) were recorded for some samples when exposed for 360 s. These results show that the Basalt rock specimens used are quite receptive to the microwave radiation such that a small input of microwave power provides for considerable heating. This is in part likely due to the presence of the microwave responsive metallic or semi-conducting mineral phases such as sulphides and iron oxides. Also pyroxene has a strongly polarizable structure that significantly increases the high temperature dielectric constant of pyroxene containing Basalt.

The specimens were allowed to cool after the microwave heating intervals, it was observed that the specimens exposed at 60 seconds and 120 seconds did not show observable cracking. However the specimens exposed at 180 seconds and 360 seconds showed some amount of cracking.

As indicated above by the results of the simulations for a calcareous rock the magnitude of the tensile stresses developed at the grain boundaries of the microwave responsive minerals and non responsive matrix exceeds the strength of the rock, which essentially indicates that damage which was initiated at the grain boundary can actually propagate into the matrix, thereby weakening the matrix. Even in the present experiments, a similar phenomenon is observed. The Basalt rock specimens used are composed of minerals which are very good microwave absorbers such as magnetite and iron rich chlorite embedded in a matrix of labrodarite and glass which are very poor absorbers of microwaves. This mineral composition of the present rock samples makes it susceptible to differential heating when exposed to microwave radiation, thereby facilitating the development and propagation of thermal cracks. These cracks are quite apparent at higher microwave exposure times. Conversion of moisture that may be present in the rock sample into steam, creating regions of localized high pressures may also promote the formation of fractures, however this phenomenon is likely not dominant due to the fact that Basalt is a dense fine grained volcanic rock. Another generator of crack formation might be the expansion of the entrapped gas pockets within the voids of the rock, as the presence of such voids is quite common in aphanitic rocks such as Basalt.

The average point load index and compressive strengths at different times of microwave exposure is provided in TABLE 10.

TABLE 10

| Microwave exposure time (Seconds) | Sample set | Point load index ($MN/m^2$) | Compressive strength (MPa) |
|---|---|---|---|
| 0 | Control Set | 5.62 | 118.25 |
| 60 | Set 1 | 5.13 | 107.87 |
| 120 | Set 2 | 4.93 | 103.46 |
| 180 | Set 3* | 4.55 | 95.74 |
| 360 | Set 4* | 3.73 | 78.546 |

(*obtained from trend corrected values)

Graphed results of the point load tests, the correlated compressive strength obtained from the point load index tests as well as typical failure pattern of the specimens by point load testing were obtained. Values of the mean compressive strength for microwave exposure times of 180 seconds and 360 seconds were also obtained from the trend line.

The point load index and hence the compressive strength show a decreasing trend with an increased exposure to microwaves, giving an indication that low power microwaves does have the potential of reducing the strength of the Basalt rock specimen.

It should be noted that point load tests could be done for the control set (not exposed to microwaves) and specimens exposed to 60 seconds and 120 seconds of microwave radiation only. The specimens that were exposed to 180 seconds and 360 seconds of microwave radiation could not be tested because of the fact that they had both localized micro cracks and macro cracks due to microwave radiation. When they were loaded in the point load tester they showed the tendency of local failure at the point of loading. As indicated earlier in the discussion the rock matrix is weakened by thermal cracks due to increased microwave exposure. This weakened matrix actually makes the specimen susceptible to indentation by point load platens rendering the test unsuitable for the specimens exposed to higher microwave times. However, this very same phenomenon makes it ideal to facilitate percussion or rotary drag drilling. Drilling involves disintegration of the rock mass by fracturing the rock at the bit rock interface under the action of different cutting forces. If the rock matrix already has induced cracks as in the present case, easier penetration is achieved with much less applied thrust. That is a rock matrix which has cracks and which previously was quite hard is now relatively soft and as a result a drilling or excavation technique suitable for soft rocks can actually be applied in place of a much more energy demanding mechanical processes.

For example as a cursory step the effect microwaves have on the rate of drilling during a typical percussive drilling process (for a top hammer having a power of drill 14-17.5 kW, blow frequency, 3000-6000 blows/min, bit diameter, 76-89 mm) can be quantified considering the fact that compressive strength of the rock has close correlation with drilling rate of percussive drilling.

A plot between the Microwave exposure times for the rock sample and penetration rate for the percussive drilling process indicates that penetration rate increases with increasing microwaving times. It is seen that there is an increase of 42% (at a microwave exposure time of 360 s) in penetration rate as compared to unmicrowaved samples. Since the specimens exposed to higher microwave times had local failures and cracks as well, at the point of loading during the point load tests it might also be the case that we might expect higher penetration rates.

It can be concluded that Basalt, which is considered one of the hardest rocks and very difficult to drill or excavate, has been weakened because of numerous thermal cracks due low power microwave exposure, and supports the further conclusion that such weakened rocks can be drilled or subjected to subsequent breakages using reduced mechanical energies.

In the present a multimode cavity was used as the microwave applicator because of its mechanical simplicity and versatility. Use of single mode applicators or focused microwave beam could induce more damage in to the rocks as with in multimode applicators there are a number of mixed modes, which tend to lower the power handling capabilities of such cavities.

Referring back to FIG. 4, once the optimum frequency (or frequencies) and/or densities of electromagnetic energy necessary for heating the aggregate/rock has been determined, and in order to provide for continuous excavation, it is sufficient to irradiate to a depth D with a power such that, at a given rate of excavation, the duration required for the cutting heads 26 to reach the depth D is sufficient to raise the temperature of materials within the aggregate sufficiently to fracture the aggregate by thermal expansion. As a result, and as only a relatively small depth D (and therefore amount of aggregate) is being irradiated at any one time, the required power of electromagnetic energy is greatly reduced.

Although the present invention has been described hereinabove by way of specific embodiments thereof, it can be modified, without departing from the spirit and nature of the subject invention as defined in the appended claims.

What is claimed is:

1. A drill bit for penetrating a material, the drill bit comprising:

a cutting face comprising at least one cutting tool;

an emitter of microwaves positioned behind said cutting face, wherein at least a portion of said microwaves are emitted in a direction away from said cutting face; and a reflector for directing said portion of said microwaves to said cutting face, wherein said reflector comprises an elongate V shaped depression in said cutting face, wherein said emitter is positioned along said V shaped depression and further wherein said emitter emits microwaves at right angles to said V shaped depression;

wherein in operation said emitted microwaves irradiate the material prior to the irradiated material being removed by said at least one cutting tool.

2. The drill bit of claim 1, wherein the material is an aggregate and said electromagnetic energy is sufficient to induce thermal expansion in the aggregate.

3. The drill bit of claim 1, wherein said V shaped depression is filled with a material transparent to microwaves.

4. The drill bit of claim 1, wherein said cutting tool is releasably attached to said cutting face.

5. The drill bit of claim 1, wherein said cutting tool has at least one stationary cutting edge, said at least one cutting edge being forced into said irradiated material to remove it.

6. The drill bit of claim 1, wherein said cutting tool revolves and has at least one cutting edge, said at least one cutting edge being forced into said irradiated material to remove it.

7. The drill bit of claim 1, wherein said cutting tool comprises at least one cutting edge with diamond inserts, said at least one cutting edge being forced into said irradiated material to remove it.

8. A microwave-assisted drilling system for excavating a shaft in a material, the system comprising:

a source of electromagnetic energy external to the shaft;

a hollow drill rod;

a source of motive energy for driving said drill rod;

an elongate coaxial waveguide positioned along an inside of said drill rod;

a drill bit attached at a distal end of said drill rod, the drill bit comprising:

a cutting tool comprising a cutting face; and a microwave antenna terminating said coaxial waveguide adjacent to said cutting tool and in operative interconnection with said source of electromagnetic energy via said waveguide, said antenna comprising an emitter of microwaves positioned behind said cutting face, wherein at least a portion of said microwaves are emitted in a direction away from said cutting face, and a reflector for directing said portion to said cutting face, said reflector comprising an elongate V shaped depression in said cutting face, wherein said emitter is positioned along said V shaped depression and further wherein said emitter emits microwaves at right angles to said V shaped depression;

wherein the material is an aggregate and said source of electromagnetic energy is operating at a frequency and intensity sufficient to induce thermal expansion in the aggregate and further wherein in operation said antenna irradiates the aggregate with said electromagnetic energy thereby inducing thermal expansion in the aggregate prior to the irradiated aggregate being removed by said cutting tool.

9. The drill bit of claim 8, wherein said V shaped depression is filled with a material transparent to microwaves.

10. The system of claim 8, wherein said antenna is off-centered from a longitudinal axis of said drill rod.

11. The system of claim 8, further comprising a pump for circulating an evacuating fluid through said drill bit.

12. The system of claim 8, wherein said source of electromagnetic energy is a magnetron.

13. The system of claim 8, wherein said source of motive force imparts a periodic percussive force to said drill bit.

14. A method of thermally treating an aggregate at the end of a shaft, the aggregate comprising a heterogeneous mixture of materials suspended in a matrix, the method comprising:

providing a drill bit comprising a cutting tool and a microwave antenna;

providing a source of electromagnetic radiation external to the shaft and operationally interconnected with said antenna;

selecting one of said materials, said selected material increasing in temperature when excited by an electromagnetic field;

determining a frequency of electromagnetic radiation which induces a thermal expansion in said selected material that is greater than a thermal expansion induced in a non-selected material; and emitting electromagnetic radiation from said antenna at said selected frequency with an intensity and duration sufficient to introduce fractures into the aggregate; and removing said fractured aggregate with said cutting tool.

15. The method of claim 14, wherein the aggregate is rock and the materials are minerals.

16. A microwave-assisted drilling system for excavating a shaft in a material, the system comprising:

a source of electromagnetic energy external to the shaft;

a hollow drill rod;

a source of motive energy for rotating said drill rod about its longitudinal axis wherein a rotary connection joins said source of electromagnetic energy to said rotating drill rod while maintaining said source of electromagnetic energy stationary;

an elongate coaxial waveguide positioned along an inside of said drill rod;

a drill bit attached at a distal end of said drill rod, the drill bit comprising:

a cutting tool; and a microwave antenna terminating said coaxial waveguide adjacent to said cutting tool and in operative interconnection with said source of electromagnetic energy via said waveguide;

wherein the material is an aggregate and said source of electromagnetic energy is operating at a frequency and intensity sufficient to induce thermal expansion in the aggregate and further wherein in operation said antenna irradiates the aggregate with said electromagnetic energy thereby inducing thermal expansion in the aggregate prior to the irradiated aggregate being removed by said cutting tool.

* * * * *